US008196613B2

(12) United States Patent
Ward

(10) Patent No.: US 8,196,613 B2
(45) Date of Patent: Jun. 12, 2012

(54) MULTI-LAYER PAPERMAKER'S FORMING FABRIC WITH PAIRED MD BINDING YARNS

(76) Inventor: Kevin John Ward, Coldbrook (CA)

( * ) Notice: Subject to any disclaimer, the term of this patent is extended or adjusted under 35 U.S.C. 154(b) by 193 days.

(21) Appl. No.: 12/700,133

(22) Filed: Feb. 4, 2010

(65) Prior Publication Data

US 2011/0036527 A1 Feb. 17, 2011

Related U.S. Application Data

(60) Provisional application No. 61/155,235, filed on Feb. 25, 2009, provisional application No. 61/262,268, filed on Nov. 18, 2009, provisional application No. 61/286,544, filed on Dec. 15, 2009.

(51) Int. Cl.
*D21F 7/08* (2006.01)
*D21F 1/10* (2006.01)
*D03D 25/00* (2006.01)

(52) U.S. Cl. ..... 139/383 A; 139/383 AA; 139/383 R; 162/358.2

(58) Field of Classification Search ..... None
See application file for complete search history.

(56) References Cited

U.S. PATENT DOCUMENTS

| | | | | |
|---|---|---|---|---|
| 5,881,764 | A * | 3/1999 | Ward | 139/383 A |
| 5,937,914 | A * | 8/1999 | Wilson | 139/383 A |
| 5,967,195 | A * | 10/1999 | Ward | 139/383 A |
| 6,123,116 | A * | 9/2000 | Ward et al. | 139/383 A |
| 6,179,013 | B1 * | 1/2001 | Gulya | 139/383 A |
| 6,379,506 | B1 * | 4/2002 | Wilson et al. | 162/348 |
| 6,585,006 | B1 * | 7/2003 | Wilson et al. | 139/383 A |
| 6,745,797 | B2 * | 6/2004 | Troughton | 139/383 A |
| 6,896,009 | B2 * | 5/2005 | Ward | 139/383 A |
| 6,959,737 | B2 * | 11/2005 | Ward | 139/383 A |
| RE40,066 | E * | 2/2008 | Ward | 139/383 A |
| 7,441,566 | B2 * | 10/2008 | Ward | 139/383 A |
| 7,766,053 | B2 * | 8/2010 | Barratte | 139/383 A |
| 7,931,051 | B2 * | 4/2011 | Ward et al. | 139/383 A |
| 2004/0182464 | A1 * | 9/2004 | Ward | 139/383 A |
| 2005/0121097 | A1 * | 6/2005 | Ward | 139/383 A |
| 2007/0125911 | A1 * | 6/2007 | Heger et al. | 245/2 |
| 2007/0157987 | A1 * | 7/2007 | Ward | 139/383 A |
| 2008/0223474 | A1 * | 9/2008 | Ward | 139/420 B |
| 2009/0183795 | A1 * | 7/2009 | Ward et al. | 139/410 |
| 2010/0108175 | A1 * | 5/2010 | Barratte | 139/383 A |
| 2011/0036527 | A1 * | 2/2011 | Ward | 162/289 |

FOREIGN PATENT DOCUMENTS

| | | |
|---|---|---|
| EP | 1 365 066 A1 | 11/2003 |
| EP | 1 724 382 A1 | 11/2006 |

OTHER PUBLICATIONS

International Search Report and Written Opinion for PCT/US2010/023693.

* cited by examiner

*Primary Examiner* — Bobby Muromoto, Jr.
(74) *Attorney, Agent, or Firm* — Myers Bigel Sibley & Sajovec

(57) ABSTRACT

A papermaker's fabric includes a series of repeat units. Each of the repeat units includes: a set of top machine direction (MD) yarns; a set of top cross-machine direction (CMD) yarns interwoven with the top MD yarns to form a top fabric layer; a set of bottom MD yarns; and a set of bottom CMD yarns interwoven with the bottom MD yarns to form a bottom fabric layer. Each bottom MD yarn passes over a top CMD yarn that its immediate neighboring top MD yarn passes under. The top MD yarns, the top CMD yarns, and the bottom MD yarns interweave to form a twill papermaking surface on the top fabric layer.

23 Claims, 12 Drawing Sheets

MULTI-LAYER PAPERMAKER'S FORMING FABRIC WITH PAIRED MD BINDING YARNS

RELATED APPLICATIONS

This application claims priority from U.S. Provisional Application No. 61/155,235, filed Feb. 25, 2009, from U.S. Provisional Application No. 61/262,268, filed Nov. 18, 2009, and from U.S. Provisional Application No. 61/286,544, filed Dec. 15, 2009, the disclosure of each of which is hereby incorporated herein in its entirety.

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rolls covered with another fabric, typically referred to as a "press felt." Pressure from the rolls removes additional moisture from the web; the moisture removal is enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now widely available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method. However, the complexity of the weaves possible with an endless weaving process is limited due to the formation and quality of the fabric at the loom edges.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

Fabrics designers are constantly looking for designs that can provide a different balance of performance properties. For example, in some fabrics, high degrees of CMD support, uniformity in top CMD yarn spacing, dimensional stability, wear volume and CMD stiffness are desirable. As such, it may be useful to provide a fabric with strong performance in these areas that is also relatively easy and/or inexpensive to weave, particularly for tissue and towel applications.

SUMMARY OF THE INVENTION

As a first aspect, embodiments of the present invention are directed to a papermaker's fabric comprising a series of repeat units. Each of the repeat units comprises: a set of top machine direction (MD) yarns; a set of top cross-machine direction (CMD) yarns interwoven with the top MD yarns to form a top fabric layer; a set of bottom MD yarns; and a set of bottom CMD yarns interwoven with the bottom MD yarns to form a bottom fabric layer. Each bottom MD yarn passes over a top CMD yarn that its immediate neighboring top MD yarn passes under. The top MD yarns, the top CMD yarns, and the bottom MD yarns interweave to form a twill papermaking surface on the top fabric layer.

As a second aspect, embodiments of the present invention are directed to a papermaker's fabric comprising a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of MD stitching yarns that interweaves with the top CMD yarns and the bottom CMD yarns. The top MD yarns, the top CMD yarns, and the stitching yarns interweave to form a twill papermaking surface on the top fabric layer. Each of the bottom MD yarns forms a plurality of knuckles under respective bottom CMD yarns, each of the stitching yarns forms at least one knuckle under a respective bottom CMD yarn, and none of the stitching yarn knuckles are formed under a bottom CMD yarn under which an adjacent bottom MD yarn forms a knuckle.

As a third aspect, embodiments of the present invention are directed to a papermaker's fabric comprising a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of MD stitching yarns that interweaves with the top CMD yarns and the bottom CMD yarns. The top MD yarns, the top CMD yarns, and the stitching yarns interweave to form a twill papermaking surface on the top fabric layer. Each of the bottom MD yarns forms a plurality of knuckles under respective bottom CMD yarns, wherein each of the stitching yarns forms at least one knuckle under a respective bottom CMD yarn, and wherein at least some of the bottom CMD yarns are passed under only by stitching yarns.

As a fourth aspect, embodiments of the present invention are directed to a papermaker's fabric comprising a series of repeat units, each of the repeat units comprising: a set of MD stitching yarns, the stitching yarns being arranged in pairs; a set of top CMD yarns interwoven with the stitching yarns to form a top fabric layer; and a set of bottom CMD yarns interwoven with the stitching yarns to form a bottom fabric layer. The stitching yarns and the top CMD yarns interweave to form a twill papermaking surface on the top fabric layer.

DETAILED DESCRIPTION OF EMBODIMENTS OF THE INVENTION

Figure 1:
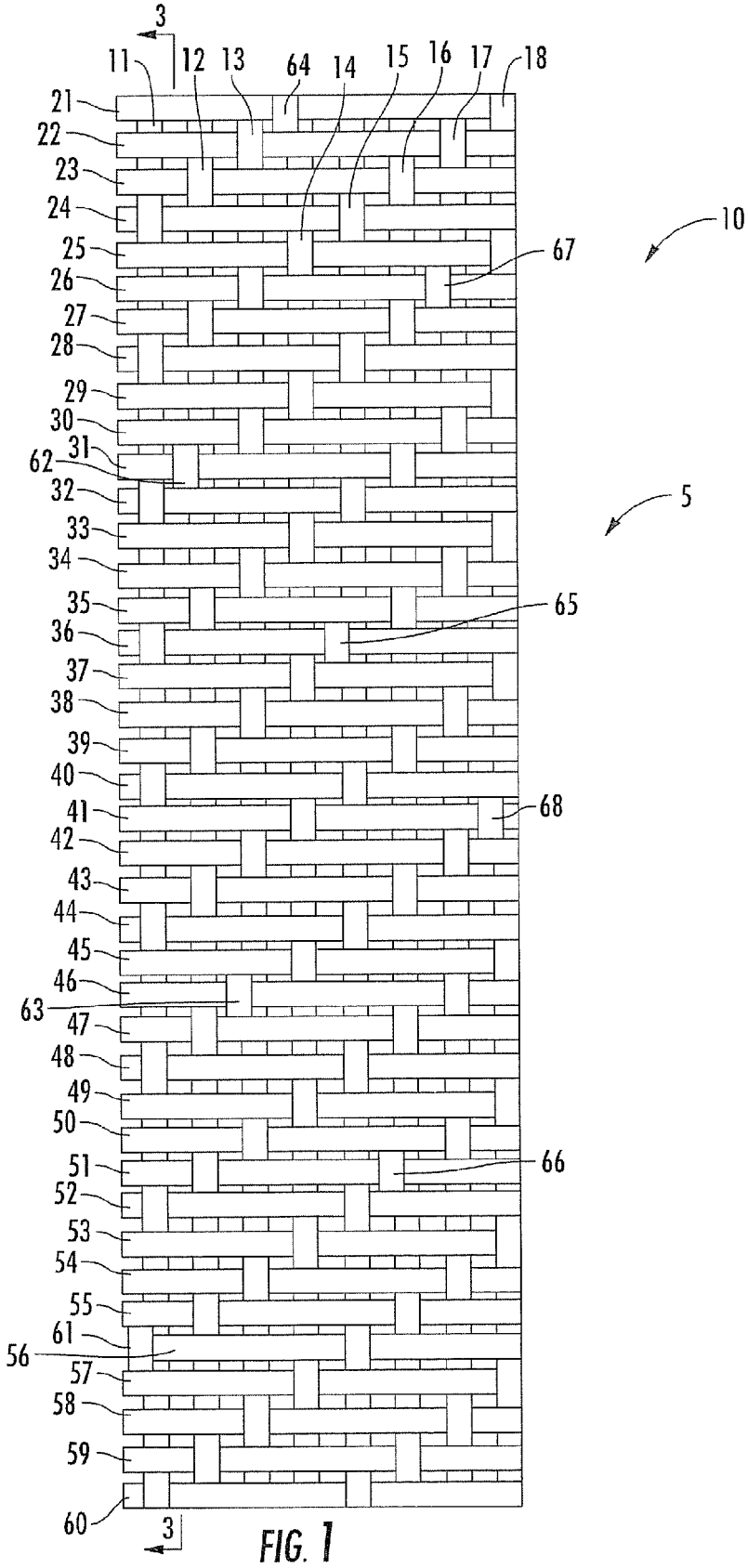
FIG. 1 is a top view of the top layer of a repeat unit of a fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Figure 2:
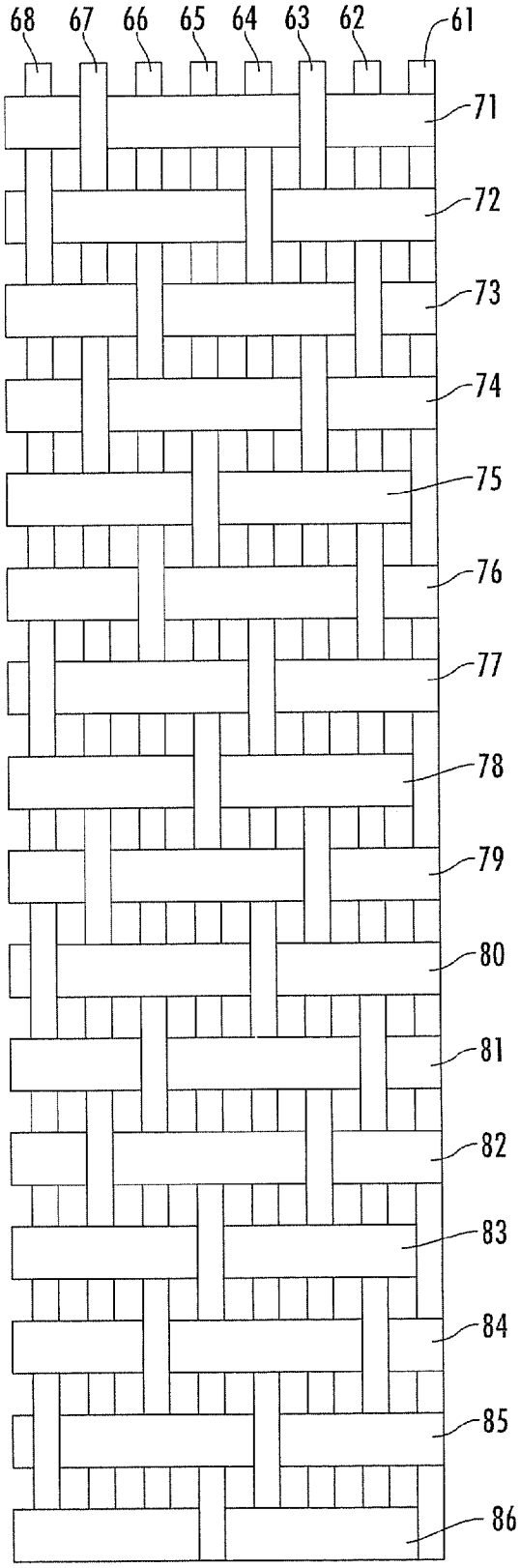
FIG. 2 is a bottom view of the bottom layer of the fabric of FIG. 1.
Figure 3:
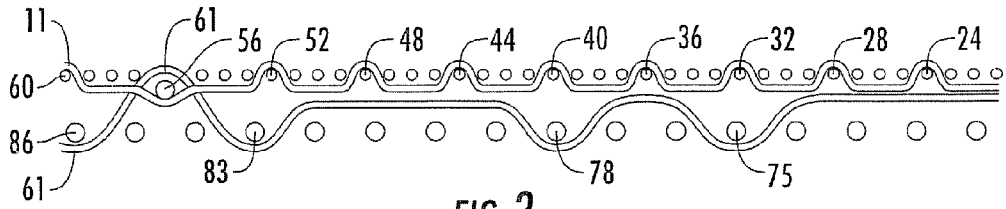
FIG. 3 is a section view taken along line 3-3 of the fabric of FIG. 1 showing typical MD yarns.
Figure 6A:
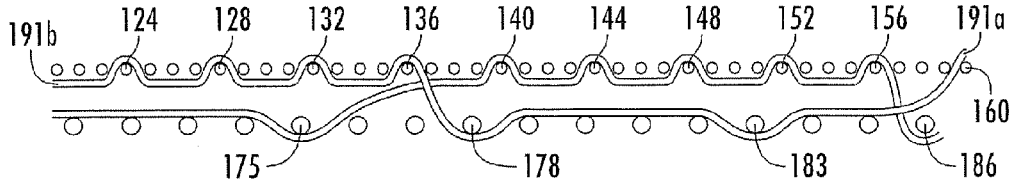
FIGS. 6A and 6B are section views taken along lines 6A-6A and 6B-6B, respectively, of the fabric of FIG. 4 showing typical MD yarns.
Figure 6B:
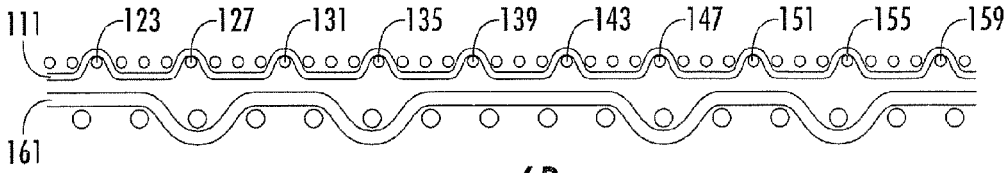

Turning now to FIGS. 1-3, a repeat unit 10 of a forming fabric 5 according to embodiments of the present invention is illustrated therein. The repeat unit 10 includes eight top MD yarns 11-18, forty top CMD yarns 21-60, eight bottom MD yarns 61-68, and sixteen bottom CMD yarns 71-86 (i.e., the ratio of top CMD yarns to bottom CMD yarns is 5:2). The interweaving of these yarns is described below.

Turning first to FIG. 1, the top surface of the fabric 10 is shown therein. Each of the top MD yarns 11-18 interweaves with the top CMD yarns in an "over 1/under 3" sequence characteristic of a 1×3 twill pattern, with the exception that each top MD yarn passes below one set of seven consecutive top CMD yarns. An adjacent bottom MD yarn 61-68 passes over the fourth CMD yarn in the aforementioned set of seven consecutive top CMD yarns, thereby forming another "under 3/over 1/under 3" sequence. The result is an overall "over 1/under 3" sequence formed by a top MD yarn, the top CMD yarns, and a bottom MD yarn.

This pattern is shown in FIGS. 1 and 3. Using top MD yarn 11 and bottom MD yarn 61 as an example, top MD yarn 11 passes under top CMD yarns 21-23, above top CMD yarn 24, below top CMD yarns 25-27, above top CMD yarn 28, below top CMD yarns 29-31, above top CMD yarn 32, below top CMD yarns 33-35, above top CMD yarn 36, below top CMD yarns 37-39, above top CMD yarn 40, below top CMD yarns 41-43, above top CMD yarn 44, below top CMD yarns 45-47, above top CMD yarn 48, below top CMD yarns 49-51, above top CMD yarn 52, below top CMD yarns 53-59 (the set of seven consecutive yarns mentioned above), and above top CMD yarn 60. Bottom MD yarn 61 passes over top CMD yarn 56, which is the fourth top CMD yarn in the set of seven consecutive top CMD yarns 53-59. As such, together top MD yarn 11 and bottom MD yarn 61 foam an "under 3/over 1" pattern with the top CMD yarns 21-60 that appears ten times in the repeat unit 10.

Adjacent top MD yarns are offset from each other by 15 top CMD yarns. As an example, with reference to FIG. 1, top MD yarn 11 passes below seven consecutive top CMD yarns 53-59, with bottom MD yarn 61 passing over top CMD yarn 56. Adjacent top MD yarn 12 passes below top CMD yarns 28-34 (which are offset from top CMD yarns 53-59 by 15 top CMD yarns), with bottom MD yarn 62 passing over top CMD yarn 31 (which is offset from top CMD yarn 56 by fifteen top CMD yarns). The result is a 1×3 twill pattern formed on the top surface of the repeat unit 10 by the top MD yarns 11-18, the top CMD yarns 21-60, and the bottom MD yarns 61-68.

Turning now to FIG. 2, the bottom MD yarns 61-68 are interwoven with the bottom CMD yarns 71-86 in an "over 4/under 1/over 2/under 1" sequence that is repeated twice in the repeat unit 10 (in FIG. 2, in which the bottom surface of the fabric is shown, the bottom MD yarns 61-68 are illustrated as passing "under 4/over 1/under 2/over 1" bottom CMD yarns 71-86; however; this is because the fabric is inverted from its orientation in FIG. 1. The convention of the top surface of the fabric representing "up" and the bottom surface of the fabric representing "down" is retained in the discussion of FIG. 2 even though the actual illustration of FIG. 2 shows otherwise). The locations where the bottom MD yarns pass below a single bottom CMD yarn are known as bottom side MD "knuckles". In addition, each bottom MD yarn 61-68 passes over one top CMD yarn 21-60 as described above; the interweaving of the bottom MD yarn 61-68 with a top CMD yarn occurs during one of the "over 2" segments of the bottom MD yarn. These stitching locations are known as top side MD knuckles.

As an example, and with reference to FIGS. 2 and 3, bottom MD yarn 61 passes over bottom CMD yarns 71-74, under bottom CMD yarn 75, over bottom CMD yarns 76 and 77, under bottom CMD yarn 78, over bottom CMD yarns 79-82, under bottom CMD yarn 83, over bottom CMD yarns 84 and 85, and under bottom MD yarn 86. As the bottom MD yarn 61 passes over bottom CMD yarns 84 and 85, it also passes over top CMD yarn 56. Adjacent bottom MD yarns are offset from each other by six bottom MD yarns. The result is a pattern in which the bottom CMD yarns form "floats" on the bottom surface of the fabric 10 under three bottom MD yarns.

A fabric having the weave pattern illustrated herein may have improved properties over prior fabrics, and in particular prior fabrics suitable for the formation of tissue paper. More specifically, such fabrics may enjoy improved uniformity of spacing of top CMD yarns. Some prior MD-stitched fabrics having a twill pattern on the papermaking surface suffer from "pairing" of the top CMD yarns, which can negatively impact uniformity of top CMD yarn spacing. In such fabrics, the top MD yarns stitch under the bottom CMD yarns. Also, because of the relatively long CMD floats on the bottom surface of the fabric, the fabric may have increased wear volume and CMD stiffness and stability over prior fabrics. Moreover, the 5:2 ratio of top CMD yarns to top MD yarns can improve the Beran's fabric support index (FSI) and the drainage index (DI) of the fabric.

A repeat unit 110 of another embodiment of a fabric 100 that utilizes principles of the invention is shown in FIGS. 4-6B and designated broadly at 110. The repeat unit 110 includes four top MD yarns 111-114, forty top CMD yarns 121-160, four bottom MD yarns 161-164, sixteen bottom CMD yarns 171-186, and eight stitching yarns 191*a*, 191*b*-194*a*, 194*b* arranged in four pairs. The interweaving of these yarns is described below.

Figure 4:
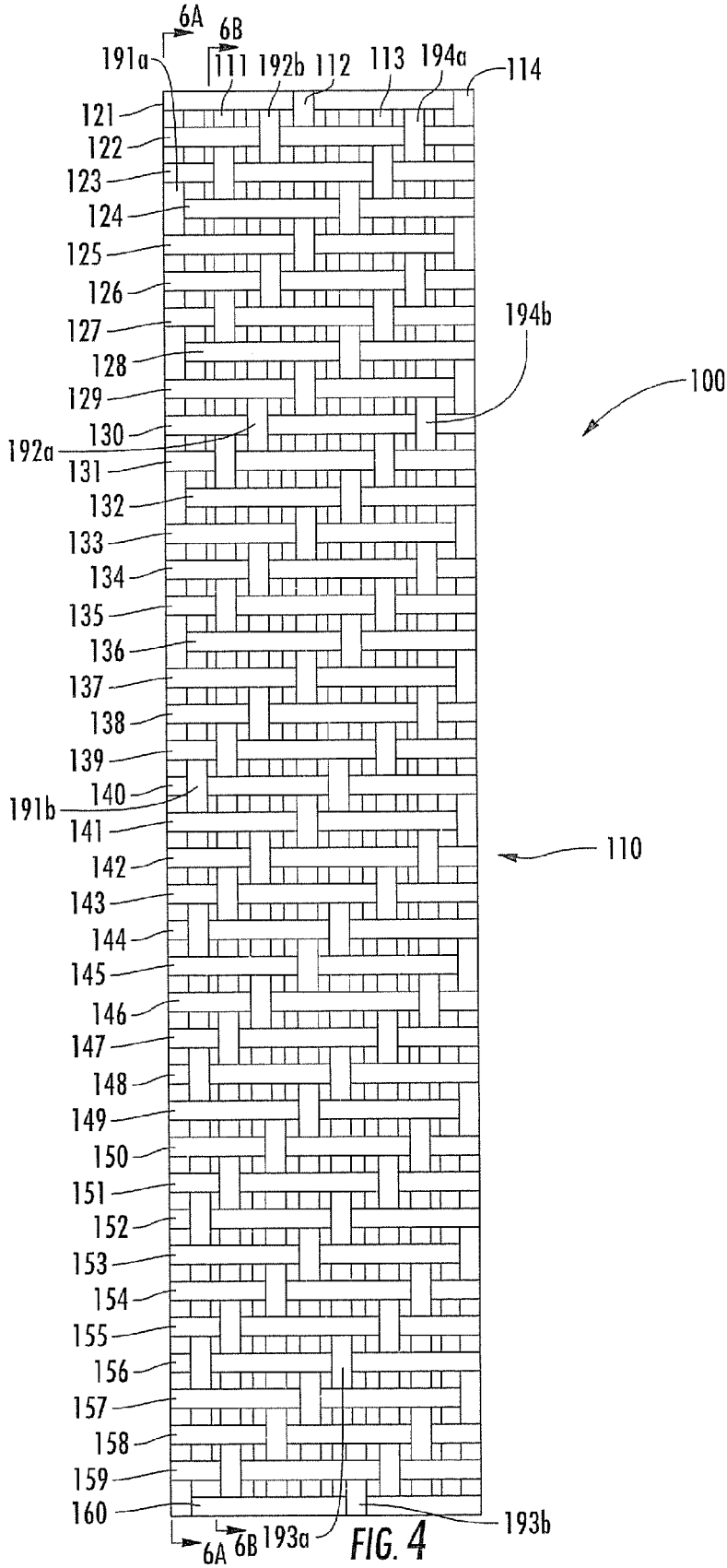
FIG. 4 is a top view of the top layer of a repeat unit of a fabric according to additional embodiments of the present invention.

Turning first to FIG. 4, the top surface of the fabric 110 is shown therein. Each of the top MD yarns 111-114 interweaves with the top CMD yarns in the "over 1/under 3" sequence illustrated in connection with the repeat unit 10. For example, top MD yarn 111 passes over top CMD yarns 123, 127, 131, 135, 139, 143, 147, 151, 155, 159 and under the remaining top CMD yarns (see FIGS. 4 and 6B). The top surface also includes portions of the stitching yarns 191*a*, 191*b*-194*a*, 194*b*, each of which combines to act as a single "composite" yarn in completing the 1×3 twill pattern on the top surface of the fabric 10. More specifically, each of the stitching yarns forms five top side knuckles, each of which is separated by sets of three consecutive top CMD yarns, with the stitching yarns designated with an "a" designation (e.g., stitching yarn 191*a* or 192*a*) passing over five top CMD yarns, and each of the stitching yarns designated with a "b" designation (e.g., stitching yarn 191*b* or 192*b*) passing over the other five other top CMD yarns. For example, and referring to FIGS. 4 and 6A, stitching yarn 191*a* passes over top CMD yarn 160, under top CMD yarns 121-123, over top CMD yarn 124, under top CMD yarns 125-127, over top CMD yarn 128, under top CMD yarn 129-131, over top CMD yarn 132, under top CMD yarns 133-135, and over top CMD yarn 136. Its paired stitching yarn 191*b* passes over top CMD yarn 140, under top CMD yarns 141-143, over top CMD yarn 144, under top CMD yarns 145-147, over top CMD yarn 148, under top CMD yarns 149-151, over top CMD yarn 152, under top CMD yarns 153-155, and over top CMD yarn 156. Thus, together the stitching yarns 191*a*, 191*b* form a "composite" top MD yarn that follows an overall "over 1/under 3" path relative to the top CMD yarns. As a result, the top MD yarns 111-114, the top CMD yarns 121-160 and the stitching yarns combine to from a 1×3 twill papermaking surface. Stitching yarn pairs are offset from each other by 10 top CMD yarns.

Figure 5:
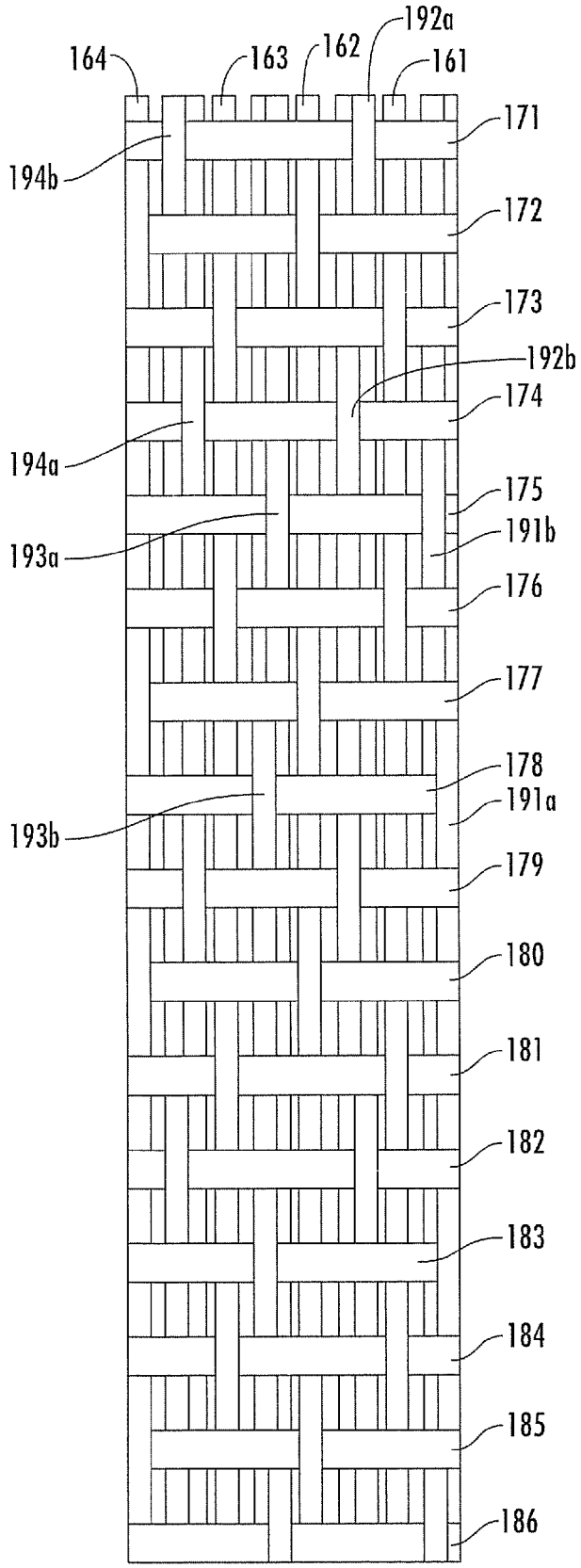
FIG. 5 is a bottom view of the bottom layer of the fabric of FIG. 4.
Figure 8:
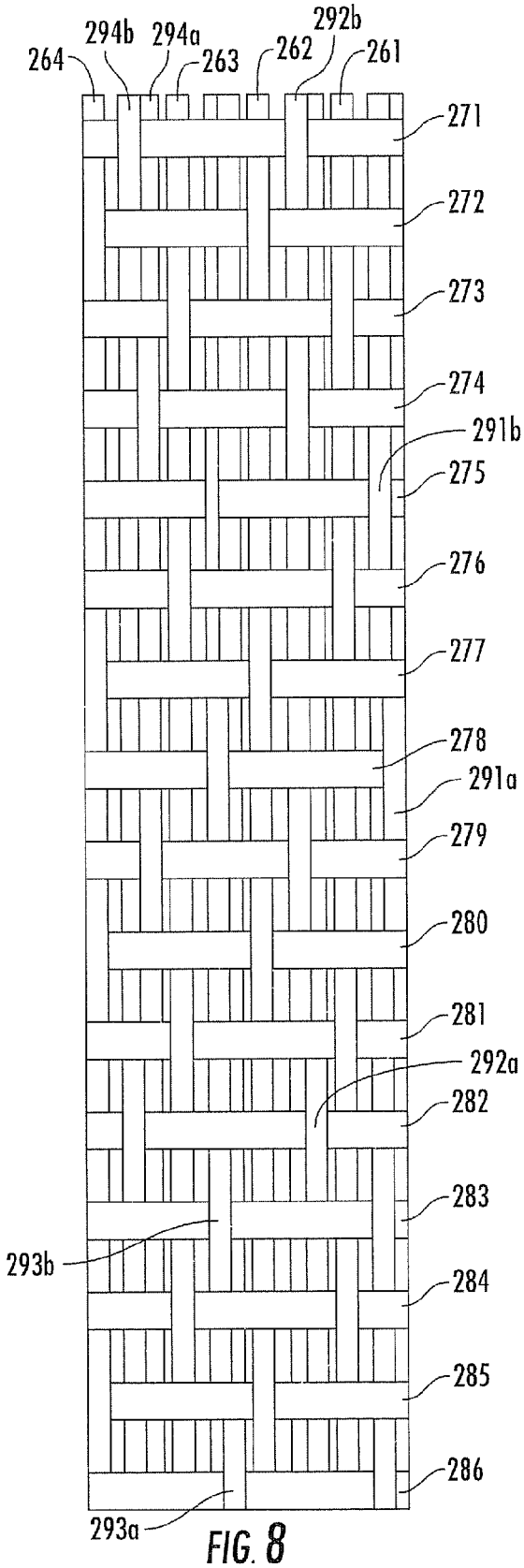
FIG. 8 is a bottom view of the bottom layer of the fabric of FIG. 7.
Figure 11:
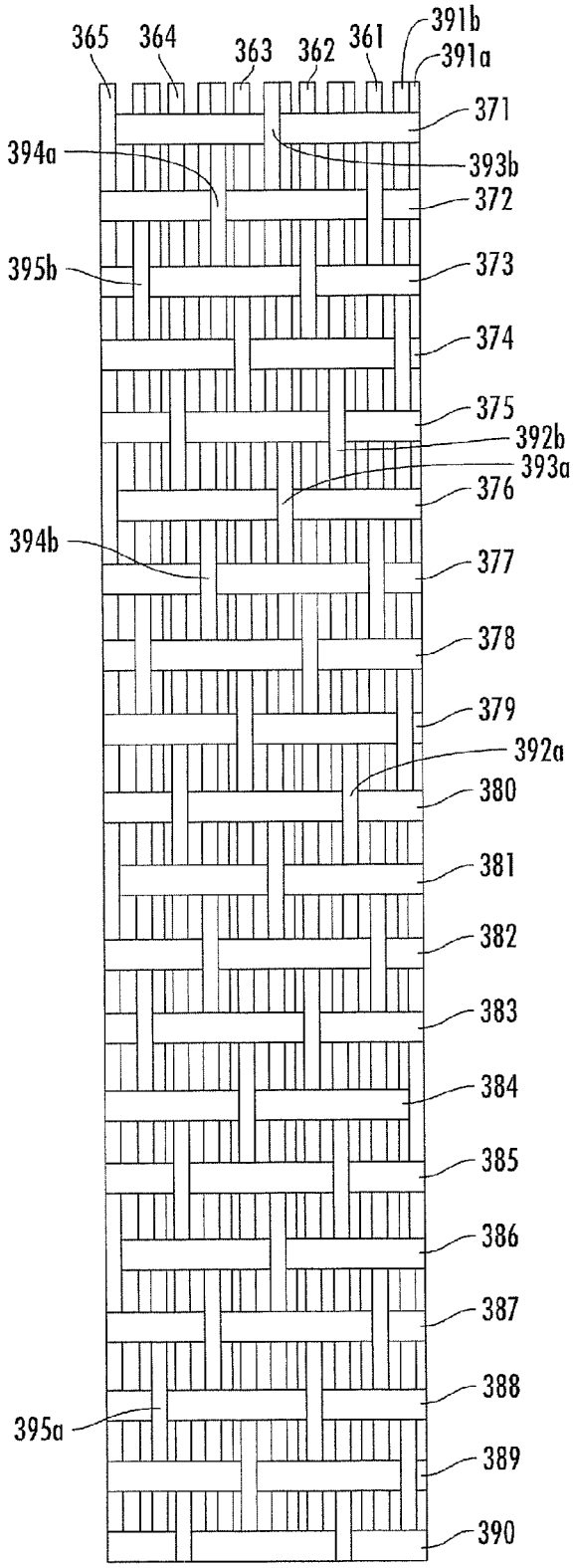
FIG. 11 is a bottom view of the bottom layer of the fabric of FIG. 10.
Figure 14:
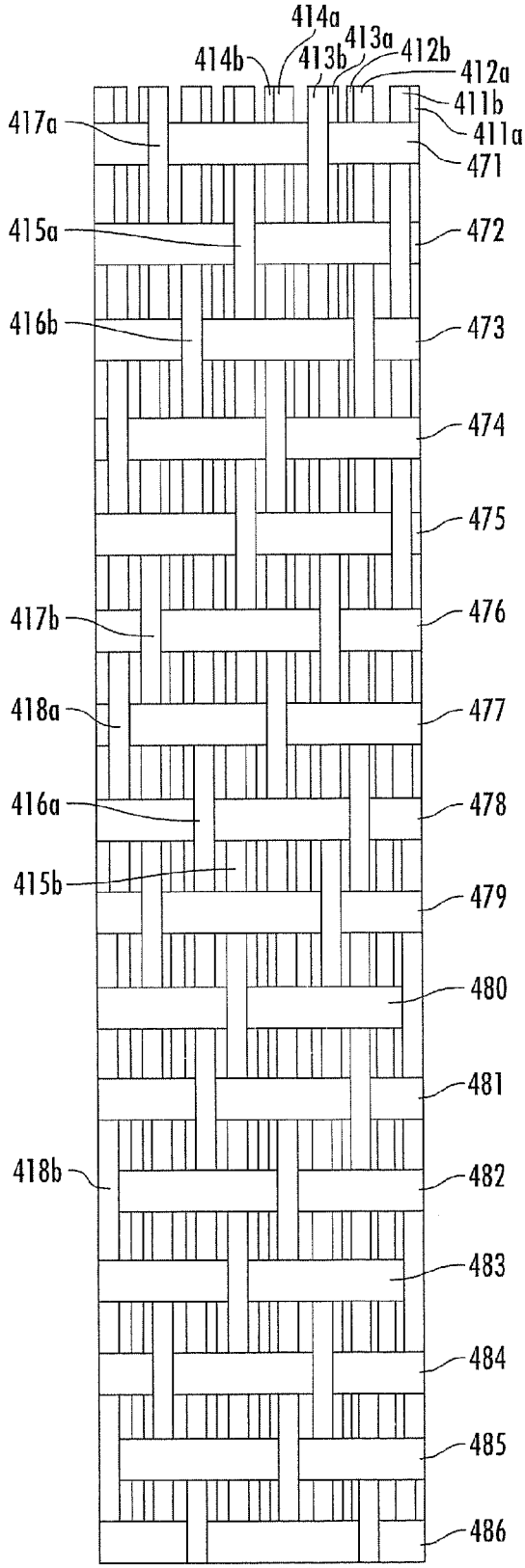
FIG. 14 is a bottom view of the bottom layer of the fabric of FIG. 13.

Turning now to FIG. 5, the bottom MD yarns 161-164 are interwoven with the bottom CMD yarns 171-186 in an "over 2/under 1/over 4/under 1/over 2/under 1/over 4/under 1" sequence in the repeat unit (as in FIG. 2, in FIG. 5 the convention of the top surface of the fabric representing "up" and the bottom surface of the fabric representing "down" is retained in the discussion of FIG. 5 even though the actual illustration of FIG. 5 shows otherwise The same is also the case for FIGS. 8, 11 and 14, infra). For example, bottom MD yarn 161 passes over bottom CMD yarns 185, 186, 171 and 172, under bottom CMD yarn 173, over bottom CMD yarns 174 and 175, under bottom CMD yarn 176, over bottom CMD yarns 177-180, under bottom CMD yarn 181, over bottom CMD yarns 182 and 183, and under bottom CMD yarn 184.

In addition, each stitching yarn 191*a*-191*b*-194*a*, 194*b* passes under two bottom CMD yarns 171-186 that are separated by four bottom CMD yarns. As such, the stitching yarns of a pair combine to form a composite bottom MD yarn that follows the "over 2/under 1/over 4/under 1/over 2/under 1/over 4/under 1" sequence mentioned earlier. For example, stitching yarn 191*a* passes under bottom CMD yarns 178 and 183, and stitching yarn 191*b* passes under bottom CMD yarns 186 and 174. Thus, together the stitching yarns 191*a*, 191*b* follow the same sequence as described above for the bottom MD yarns. The bottom CMD yarns fowl relatively long bottom floats (they are three bottom MD yarns/stitching yarns in length).

The fabric 100 may exhibit some of the same performance advantages as are described above for the fabric 10, and may further enjoy improved straight-through drainage, permeability, FSI and DI. In some embodiments, the fabric 200 may be woven from three different warp beams; in others, two warp beams may be used in conjunction with a heater bar to accommodate the differences in warp yarn crimps off each beam.

A repeat unit 210 of another embodiment of a forming fabric 200 of the present invention is illustrated in FIGS. 7-9B. The repeat unit 210 includes four top MD yarns 211-214, forty top CMD yarns 221-260, four bottom MD yarns 261-264, sixteen bottom CMD yarns 271-286, and eight stitching yarns 291*a*, 291*b*-294*a*, 294*b* arranged in four pairs. The interweaving of these yarns is described below.

Figure 7:
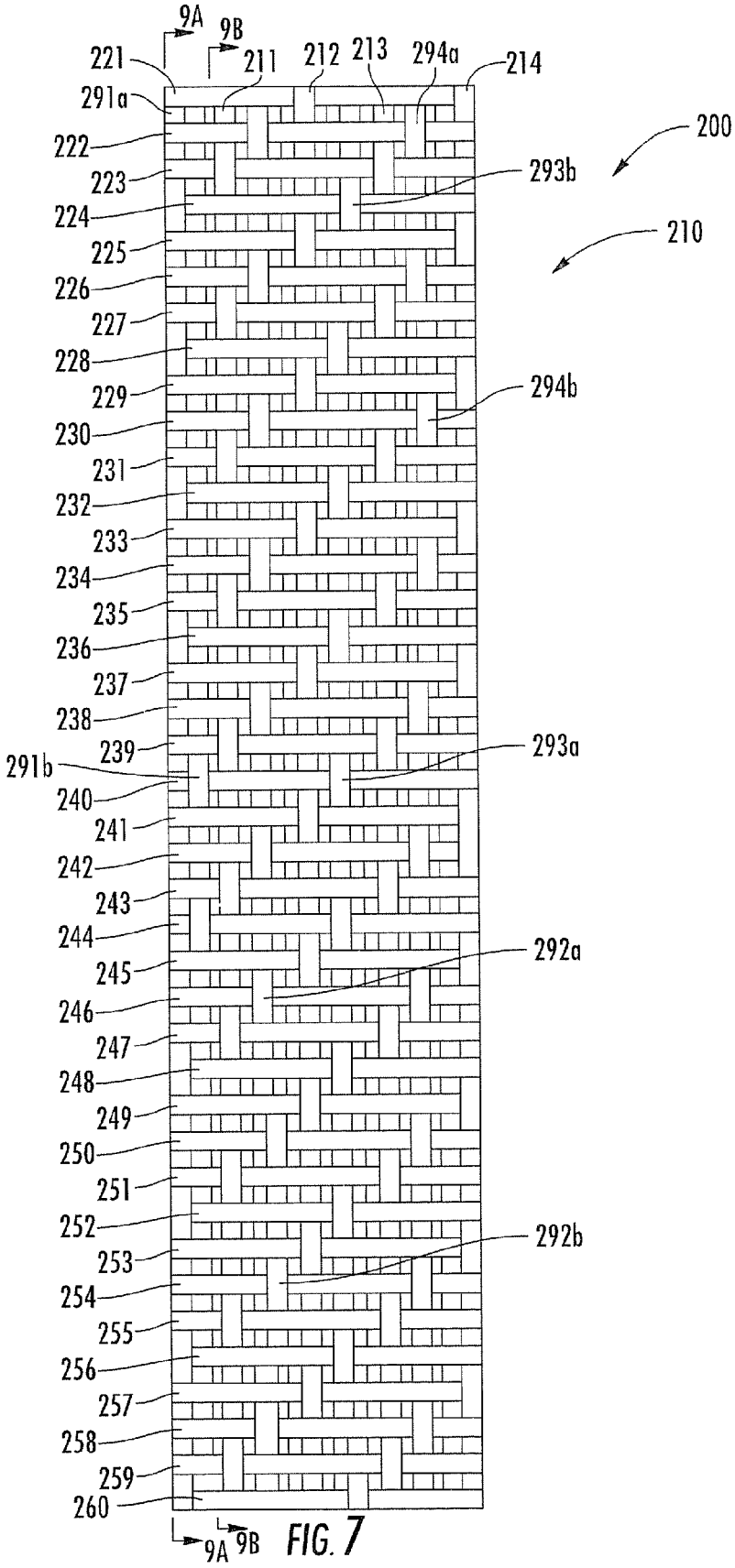
FIG. 7 is a top view of the top layer of a repeat unit of a fabric according to embodiments of the present invention.

Turning first to FIG. 7, the top surface of the repeat unit 210 is shown therein. Each of the top MD yarns 211-214 interweaves with the top CMD yarns in the "over 1/under 3" sequence illustrated in connection with the repeat unit 10. Referring to FIG. 9B, top MD yarn 211 passes over top CMD yarns 223, 227, 231, 235, 239, 243, 247, 251, 255, 259 and under the remaining top CMD yarns. As is the case with the fabric 100, the top surface also includes portions of the stitching yarns 291*a*, 291*b*-294*a*, 294*b*, each of which combines to act as a single "composite" yarn in completing the 1×3 twill pattern on the top surface of the fabric 200. However, the fabric 200 differs in that the portions of the stitching yarns 291*a*, 291*b*-294*a*, 294*b* that interweave with the top CMD yarns 221-260 are not of the same length. In each pair of stitching yarns, the stitching yarn with an "a" designation passes over eight top CMD yarns (each of which is separated by three consecutive top CMD yarns), thereby forming eight top side knuckles, and the stitching yarn with a "b" designation passes over two top CMD yarns (which are separated by three consecutive top CMD yarns), thereby forming two top side knuckles. The stitching yarn pairs are offset from each other by 10 top CMD yarns.

Figure 9A:
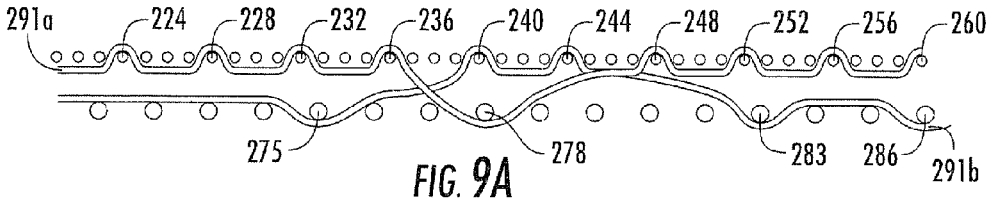
FIGS. 9A and 9B are section views taken along lines 9A-9A and 9B-9B, respectively, of the fabric of FIG. 7 showing typical MD yarns.
Figure 9B:
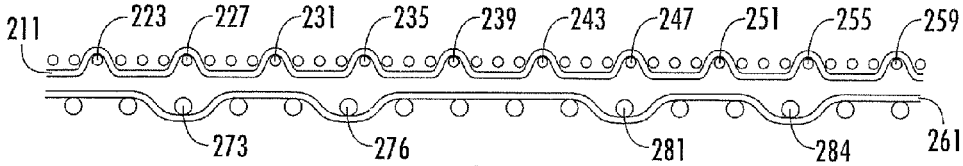

As an example, and referring to FIGS. 7 and 9A, stitching yarn 291*a* passes over top CMD yarns 248, 252, 256, 260, 224, 228, 232 and 236 and under top CMD yarns 249-251, 253-255, 257-259, 221-223, 225-227, 229-231 and 233-235. Stitching yarn 291*b* passes over top CMD yarns 240 and 244 and under top CMD yarns 241-243. Thus, together stitching yarns 291*a*, 219*b* form a composite yarn that follows an "over 1/under 3" pattern like that of the top MD yarns 211-214, with the result that the top MD yarns 211-214 and the stitching yarns 291*a*, 291*b*, 294*a*, 294*b* form a 1×3 twill surface.

Turning now to FIG. 8, the bottom MD yarns 261-264 follow the "over 2/under 1/over 4/under 1/over 2/under 1/over 4/under 1" sequence described above for the fabric 100. This sequence is demonstrated by bottom MD yarn 261 in FIG. 9B, which passes below bottom CMD yarns 273, 276, 281 and 284. The stitching yarns 291*a*, 291*b*-294*a*, 294*b* combine to form composite yarns that follow the same sequence. However, in this embodiment, the stitching yarns with an "a" designation form only one of the bottom MD knuckles, and the stitching yarns with a "b" designation form three of the bottom MD knuckles. For example, and as shown in FIG. 9A, stitching yarn 291*a* passes below bottom CMD yarn 278, and stitching yarn 291*b* passes below bottom CMD yarns 275, 281 and 284 (thereby forming the composite yarn with the "over 2/under 1/over 4/under 1/over 2/under 1/over 4/under 1" sequence mentioned above).

The fabric 200 may have the performance advantages of the fabric 100, and may also be woven more easily using only two warp beams since the stitching warps that interlace the top wefts eight times have a crimp which is very similar to the crimp of the top warp yarns; and the stitching warps that interlace the top wefts only twice have a crimp with is very similar to the crimp of the bottom warp yarns. Thus, when the warp yarns are appropriately coupled, there is very minimal difference in crimp between warp yarns off the same warp beam.

A repeat unit 310 of another fabric embodiment, designated broadly at 300, is illustrated in FIGS. 10-12B. The repeat unit 310 of the fabric 300 includes five top MD yarns 301-305, fifty top CMD yarns 311-360, five bottom MD yarns 361-365, twenty bottom CMD yarns 371-390, and ten stitching yarns 391*a*, 391*b*-395*a*, 395*b* arranged in five pairs. The interweaving of these yarns is described below.

Figure 10:
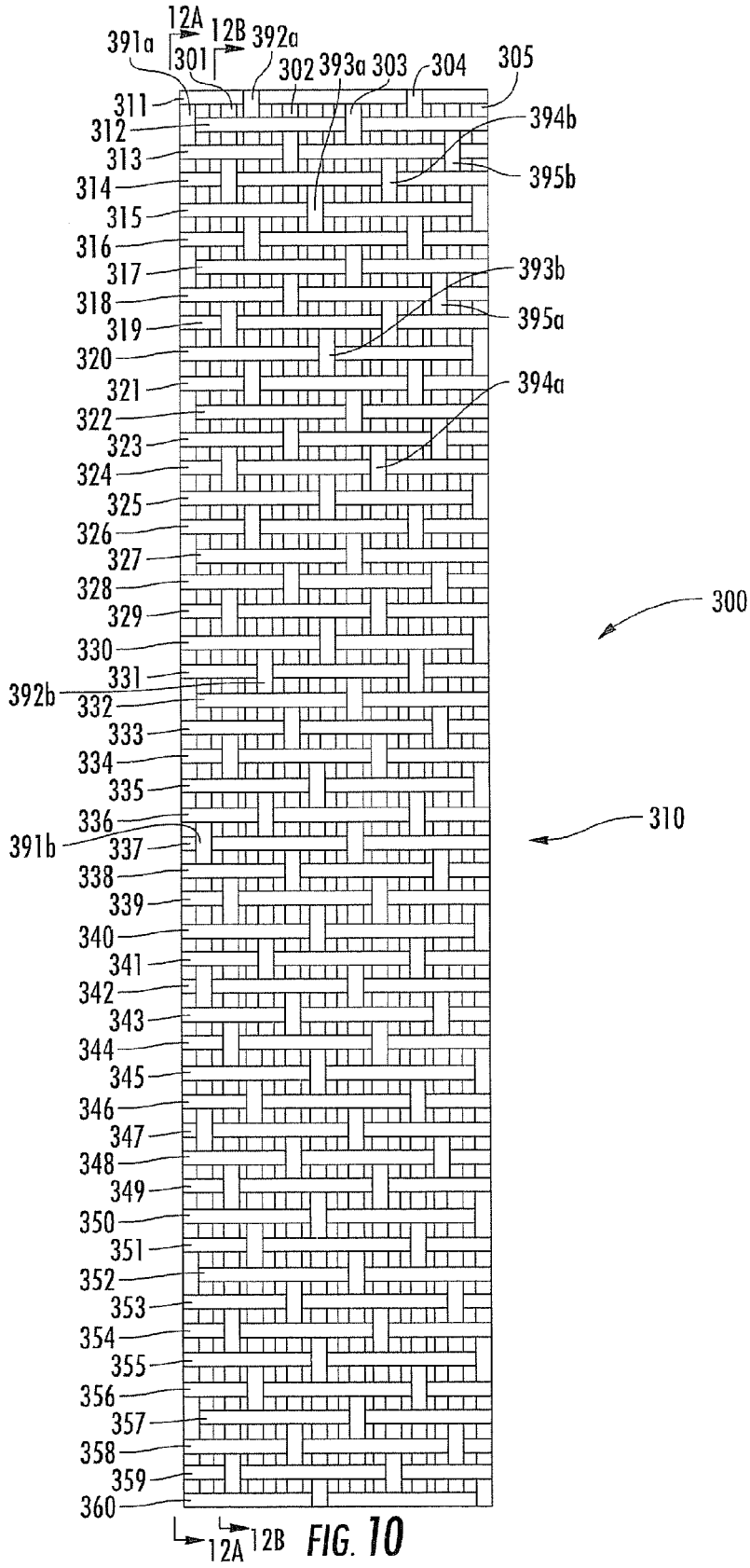
FIG. 10 is a top view of the top layer of a repeat unit of a fabric according to additional embodiments of the present invention.

Turning first to FIG. 10, the top surface of the fabric 310 is shown therein. Each of the top MD yarns 301-305 interweaves with the top CMD yarns in an "over 1/under 4" sequence. For example, top MD yarn 301 passes over top CMD yarns 314, 319, 324, 329, 334, 339, 344, 349, 354, 359 and under the remaining top CMD yarns. As is the case with the fabric 200, the top surface of the repeat unit 310 also includes portions of the stitching yarns 391*a*, 391*b*-395*a*, 395*b*, each of which combines to act as a single "composite" yarn in completing a 1×4 twill pattern on the top surface of the fabric 300. Like the fabric 200, the top surface of the fabric 300 has portions of the stitching yarns 391*a*, 391*b*-395*a*, 395*b* that interweave with the top CMD yarns 21-60 that are not of the same length. In each pair of stitching yarns, the stitching yarn with an "a" designation passes over seven top CMD yarns (each of which is separated by four consecutive top CMD yarns), and the stitching yarn with a "b" designation passes over three top CMD yarns (which are separated by four consecutive top CMD yarns).

Figure 12A:
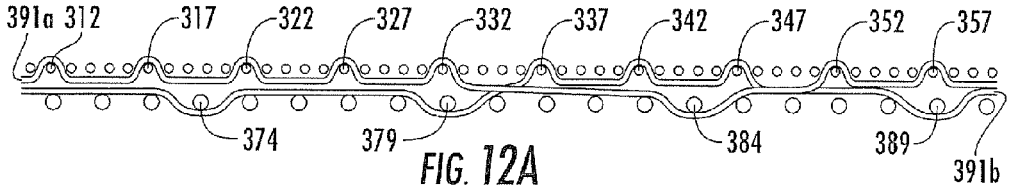
FIGS. 12A and 12B are section views taken along lines 12A-12A and 12B-12B, respectively, of the fabric of FIG. 10 showing typical MD yarns.
Figure 12B:
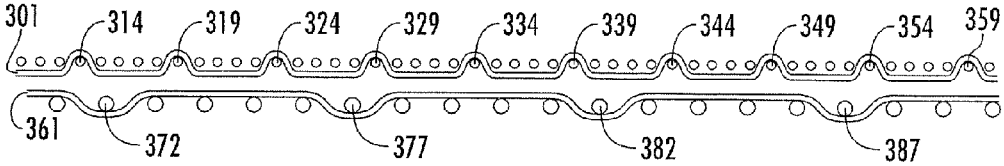

As an example, and referring to FIGS. 10 and 12A, stitching yarn 391*a* passes over top CMD yarns 312, 317, 322, 327, 332, 352 and 357 and under top CMD yarns 311, 313-316, 318-321, 323-326, 328-331, 353-356 and 358-360. Stitching yarn 291*b* passes over top CMD yarns 337, 342 and 347 and under top CMD yarns 338-341 and 343-346. Thus, together stitching yarns 291*a*, 219*b* form a composite yarn that follows an "over 1/under 4" pattern like that of the top MD yarns 311-315, with the result that the top MD yarns 311-315 and the stitching yarns 391*a*, 391*b*, 395*a*, 395*b* form a 1×4 twill five harness satin surface.

Turning now to the bottom surface of the fabric 300, and referring to FIG. 11, the bottom MD yarns 361-365 follow an "over 4/under 1/over 4/under 1/over 4/under 1/over 4/under 1" sequence. This sequence is demonstrated by bottom MD yarn 361 in FIG. 12B. The stitching yarns 391*a*, 391*b*-395*a*, 395*b* combine to form composite yarns that follow the same sequence. However, in this embodiment, the stitching yarns with an "a" designation form only one of the bottom MD knuckles, and the stitching yarns with a "b" designation form three of the bottom MD knuckles. For example, and as shown in FIG. 12A, stitching yarn 391*a* passes below bottom CMD yarn 384, and stitching yarn 391*b* passes below bottom CMD yarns 374, 379 and 389 (thereby forming the composite yarn with the "over 4/under 1/over 4/under 1/over 4/under 1/over 4/under 1" sequence mentioned above).

The fabric 300 may also enjoy the performance advantages of the fabrics 10, 100 and 200, but the 20 harness structure may offer higher permeability, FSI, DI and wear volume/life potential.

Figure 15:
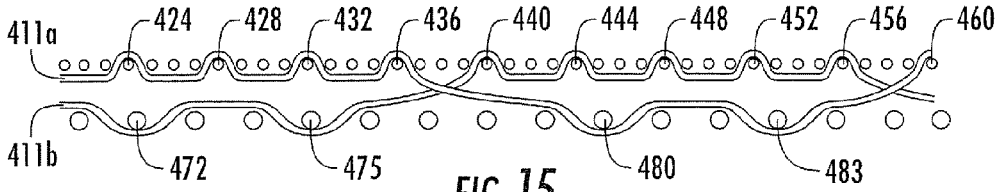
FIG. 15 is a section view taken along lines 15-15 of the fabric of FIG. 13 showing typical MD yarns.
Figure 13:
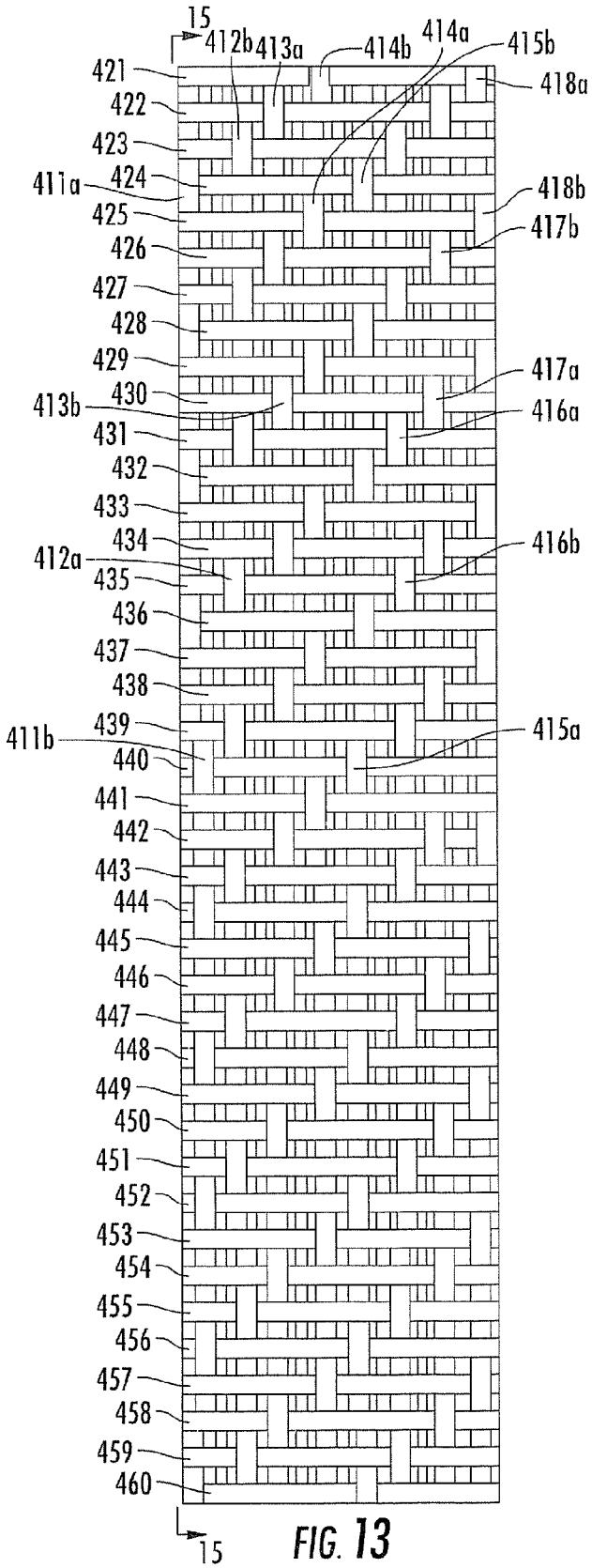
FIG. 13 is a top view of the top layer of a repeat unit of a fabric according to additional embodiments of the present invention.

Still another papermaker's fabric according to embodiments of the present invention is shown in FIGS. 13-15 and designated broadly at 400. A repeat unit 410 of the fabric 400 includes eight pairs of MD stitching yarns 411*a*, 411*b*-418*a*, 418*b*, forty top CMD yarns 421-460, and sixteen bottom CMD yarns 471-486. The interweaving of these yarns is described below.

The stitching yarns 411*a*, 411*b*-418*a*, 418*b* are interwoven with the top CMD yarns 421-460 to form a 1×3 twill surface much like that of the fabrics 10, 110, 210 above. The yarns of each of the stitching yarn pairs combine to form a "composite" yarn that follows the "under 3/overt" sequence that is characteristic of a 1×3 twill pattern. Each of the stitching yarns of a pair passes over five top CMD yarns to form top side knuckles; each of the top side knuckles is separated by three top CMD yarns. For example, and as shown in FIGS. 13 and 15A, stitching yarn 411*a* passes over top CMD yarns 460, 424, 428, 432, 436, and stitching yarn 411*b* passes over top CMD yarns 440, 444, 448, 452, 456; thus, together the stitching yarns 411*a*, 411*b* form a composite yarn that has the "under 3/over 1" sequence described above for the entire length of the repeat unit. The remaining stitching yarn pairs similarly form composite yarns that follow the "under 3/over 1" sequence.

Turning now to FIG. 14, the stitching yarn pairs 411*a*, 411*b*-418*a*, 418*b* combine to interweave with the bottom CMD yarns 471-486 in the "over 2/under 1/over 4/under 1/over 2/under 1/over 4/under 1" described above for fabrics 10, 100, 200. As shown in FIGS. 14 and 15B, as an example stitching yarn 411*b* passes below bottom CMD yarns 472 and 475, and stitching yarn 411*a* passes below bottom CMD yarns 480 and 483. Thus, together the stitching yarns 411*a*, 411*b* follow the "over 2/under 1/over 4/under 1/over 2/under 1/over 4/under 1" sequence as described above.

This fabric may have the performance advantages described above for fabrics 10, 100, 200 and 300, and may also have even further improved weft spacing and topography and straight-through drainage. In addition, since all of the warps have the same crimp, this embodiment can easily be woven on a loom with two warp beams, or even one warp beam.

Each of these fabrics can exhibit improved FSI, DI and permeability over similar fabrics. Also, weaving costs can be reduced over fabrics that have a higher density of stitching weft yarn pairs.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. However, in many embodiments, monofilaments are preferred. Also, the materials comprising yarns employed in the fabric of the present invention may be those commonly used in papermaker's fabric. For example, the yarns may be formed of polyester, polyamide (nylon), polypropylene, aramid, or the like. In addition, these polymers may contain additives or may be blended with other polymers to impart special properties to the monofilaments, such as improved contamination, stretch, abrasion and/or chemical resistance, to further enhance forming fabric performance. The skilled artisan should select a yarn material according to the particular application of the final fabric. In particular, round monofilament yarns formed of polyester or polyamide may be suitable, and, as noted, the use of monofilament yarns as bottom MD yarns may be particularly suitable.

Those skilled in this art will appreciate that yarns of different sizes may be employed in fabric embodiments of the present invention. In embodiments that include both top and bottom MD yarns, the top MD yarns may be of a smaller diameter than the bottom MD yarns. Stitching yarns are typically of a similar diameter to top MD yarns. For example, the top MD yarns, top CMD yarns, and stitching yarns may have a diameter of between about 0.10 and 0.17 mm, the bottom MD yarns may have a diameter of between about 0.10 and 0.17 mm, and the bottom CMD yarns may have a diameter of between about 0.18 and 0.28 mm, particularly for tissue and towel applications. The mesh of fabrics according to embodiments of the present invention may also vary. For example, the mesh of the top surface may vary between about 30×30 to 42×50 (epcm to ppcm), and the total mesh may vary between about 60×42 to 84×70.

In addition, the numbers of different types of yarns relative to other types of yarns may vary. For example, in some embodiments, the number of top CMD yarns to bottom CMD yarns is 5:2; however, other ratios, such as 1:1, 2:1, 3:1 and 3:2 may also be employed. However, embodiments with a 5:2 ratio may be particularly preferred because they can provide an excellent balance of properties including permeability, fiber support, stability and wear volume. In particular, CMD fiber support may be improved over fabrics with a 2:1 ratio because there are more top CMD yarns per inch.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer, wherein the top MD yarns interweave only with the top CMD yarns;

a set of bottom MD yarns; and a set of bottom CMD yarns interwoven with the bottom MD yarns to form a bottom fabric layer;

wherein each bottom MD yarn passes over a top CMD yarn that its immediate neighboring top MD yarn passes under; and wherein the top MD yarns, the top CMD yarns, and the bottom MD yarns interweave to form a twill papermaking surface on the top fabric layer.

2. The papermaker's fabric defined in claim 1, wherein the twill papermaking surface is a 1×3 twill.

3. The papermaker's fabric defined in claim 1, wherein each bottom CMD yarn forms at least two bottom surface CMD floats, and wherein the bottom surface CMD floats are of uniform length.

4. The papermaker's fabric defined in claim 3, wherein the bottom surface CMD floats pass below three consecutive MD yarns.

5. The papermaker's fabric defined in claim 1, wherein each bottom MD yarn includes a segment in which the bottom MD yarn passes over two consecutive bottom CMD yarns, and wherein the bottom MD yarn passes over a top CMD yarn in the segment.

6. The papermaker's fabric defined in claim 1, wherein the ratio of top CMD yarns to bottom CMD yarns is 5:2.

7. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer, wherein the top MD yarns interweave only with the top CMD yarns;

a set of bottom MD yarns;

a set of bottom CMD yarns interwoven with the bottom MD yarns to form a bottom fabric layer; and a set of MD stitching yarns that interweaves with the top CMD yarns and the bottom CMD yarns;

wherein the top MD yarns, the top CMD yarns, and the stitching yarns interweave to form a twill papermaking surface on the top fabric layer; and wherein each of the bottom MD yarns forms a plurality of knuckles under respective bottom CMD yarns, each of the stitching yarns forms at least one knuckle under a respective bottom CMD yarn, and none of the stitching yarn knuckles are formed under a bottom CMD yarn under which an adjacent bottom MD yarn forms a knuckle.

8. The papermaker's fabric defined in claim 7, wherein the twill papermaking surface is a 1×3 twill.

9. The papermaker's fabric defined in claim 7, wherein each bottom CMD yarn forms at least two bottom surface CMD floats, and wherein the bottom surface CMD floats are of uniform length.

10. The papermaker's fabric defined in claim 9, wherein the bottom surface CMD floats pass below three consecutive MD yarns.

11. The papermaker's fabric defined in claim 7, wherein the twill papermaking surface is a 1×4 twill five harness satin.

12. The papermaker's fabric defined in claim 7, wherein the ratio of top CMD yarns to bottom CMD yarns is 5:2.

13. The papermaker's fabric defined in claim 7, wherein each of the stitching yarns forms multiple knuckles over top CMD yarns.

14. The papermaker's fabric defined in claim 13, wherein each stitching yarn of a pair forms a different number of knuckles over top CMD yarns than the other stitching yarn of that pair.

15. The papermaker's fabric defined in claim 13, wherein each stitching yarn of a pair forms the same number of knuckles over top CMD yarns as the other stitching yarn of that pair.

16. The papermaker's fabric defined in claim 7, wherein the stitching yarns of each pair are interwoven in the top layer to form a composite yarn that follows the same weaving sequence relative to the top CMD yarns as the top MD yarns, and wherein the stitching yarns of each pair are interwoven in the bottom layer to form a composite yarn that follows the same weaving sequence relative to the bottom CMD yarns as the bottom MD yarns.

17. A papermaker's fabric comprising a series of repeat units, each of the repeat units comprising:

a set of top machine direction (MD) yarns;

a set of top cross-machine direction (CMD) yarns interwoven with the top MD yarns to form a top fabric layer, wherein the top MD yarns interweave only with the top CMD yarns;

a set of bottom MD yarns;

a set of bottom CMD yarns interwoven with the bottom MD yarns to form a bottom fabric layer; and a set of MD stitching yarns that interweaves with the top CMD yarns and the bottom CMD yarns;

wherein the top MD yarns, the top CMD yarns, and the stitching yarns interweave to form a twill papermaking surface on the top fabric layer;

wherein each of the bottom MD yarns forms a plurality of knuckles under respective bottom CMD yarns, wherein each of the stitching yarns forms at least one knuckle under a respective bottom CMD yarn, and wherein at least some of the bottom CMD yarns are passed under only by stitching yarns.

18. A papermaker's fabric comprising a series of repeat units, each of the repeat units comprising:

a set of machine direction (MD) stitching yarns, the stitching yarns being arranged in pairs;

a set of top cross-machine direction (CMD) yarns interwoven with the stitching yarns to form a top fabric wherein the top MD yarns interweave only with the top CMD yarns; and a set of bottom CMD yarns interwoven with the stitching yarns to form a bottom fabric layer;

wherein the stitching yarns and the top CMD yarns interweave to form a twill papermaking surface on the top fabric layer;

wherein the ratio of top CMD yarns to bottom CMD yarns is 5:2.

19. The papermaker's fabric defined in claim 18, wherein each of the stitching yarns forms at least one knuckle under a respective bottom CMD yarn.

20. The papermaker's fabric defined in claim 19, wherein each of the stitching yarns forms two knuckles under respective bottom CMD yarns.

21. The papermaker's fabric defined in claim 18, wherein each of the stitching yarns forms a plurality of knuckles over top CMD yarns, and wherein each of the stitching yarns forms the same number of knuckles.

22. The papermaker's fabric defined in claim 18, wherein the twill pattern is a 1×3 twill pattern.

23. The papermaker's fabric defined in claim 18, wherein the twill papermaking surface is a 1×4 twill five harness satin.

* * * * *